US005494287A

United States Patent [19]

Manz

[11] Patent Number: 5,494,287

[45] Date of Patent: Feb. 27, 1996

[54] GAMING MACHINE HAVING DYNAMIC PAYOUT AMOUNTS

[75] Inventor: Robert P. Manz, Las Vegas, Nev.

[73] Assignee: Bally Gaming International, Inc., Las Vegas, Nev.

[21] Appl. No.: 263,273

[22] Filed: Jun. 21, 1994

[51] Int. Cl.[6] ..... G07F 17/34; A63F 5/04

[52] U.S. Cl. ..... 273/143 R

[58] Field of Search ..... 273/85 CP, 138 R, 273/138 A, 143 R, 269, 292

[56] References Cited

U.S. PATENT DOCUMENTS

| | | | |
|---|---|---|---|
| 4,624,459 | 11/1986 | Kaufman | 273/143 R |
| 4,695,053 | 9/1987 | Vazquez, Jr. et al. | 273/143 R |
| 4,837,728 | 6/1989 | Barrie et al. | 273/143 R |
| 5,123,649 | 6/1992 | Tiberio | 273/143 R |
| 5,205,555 | 4/1993 | Hamano | 273/143 R |
| 5,259,616 | 11/1993 | Bergmann | 273/138 A |

FOREIGN PATENT DOCUMENTS

| | | | |
|---|---|---|---|
| 3915655 | 11/1990 | Germany | 273/143 R |
| 2098779 | 11/1982 | United Kingdom | 273/143 R |

*Primary Examiner*—Jessica J. Harrison
*Attorney, Agent, or Firm*—Jenner & Block

[57] ABSTRACT

A dynamic payout system and method for a gaming machine permit the random selection of a payout for a particular game outcome from a predetermined range of payout amounts. The player is provided with a range of possible payouts that may be paid upon the occurrence of a particular game outcome. When the player initiates game play, an input-output interface generates an initiate signal. A game control microprocessor, in response to the initiate signal, randomly selects a game outcome that includes a metered winning game outcome. If a winning game outcome occurs, the microprocessor then randomly selects a payout amount from a predetermined range of payout amounts stored in memory, which includes metered payout amounts. A meter display displays the metered payout amount. A payout device such as a coin hopper dispenses the metered payout amount. Additional features of the system include a meter display that incrementally displays the metered payout amount and a coin hopper that incrementally dispenses the metered payout amount synchronously with the incremental display of the metered payout amount.

7 Claims, 4 Drawing Sheets

80

| 82 WEIGHTING FACTOR | | 84 PAYMENT AMOUNT |
|---|---|---|
| 0 | 20 | 250 |
| 21 | 38 | 251 |
| 39 | 45 | 252 |
| ⋮ | ⋮ | ⋮ |
| 990 | 995 | 498 |
| 996 | 998 | 499 |
| 999 | | 500 |

GAMING MACHINE HAVING DYNAMIC PAYOUT AMOUNTS

FIELD OF THE INVENTION

The invention relates to the field of gaming machines, and more particularly, to gaming machines that generate a payout of money upon the occurrence of certain game outcomes.

BACKGROUND OF THE INVENTION

Widely known gaming machines have displays of symbols which form combinations, some of which are designated as winning combinations. For example, traditional slot machines have three to five rotatable reels arranged side by side, which are visible through a glass panel containing a win line. These gaming machines usually employ mechanically spinning physical reels or more recently, video displays of spinning reels. The reels are rotated through a number of angular reel stop positions, and include symbols such as bars or fruit, which are rotated on the peripheral surface of the reels to indicate the reel stop positions. As each reel rotates, its symbols are repetitively displayed in serial order and in visual association with the win line. In other types of video gaming machines, including such games as poker or black jack, the symbols displayed on the video screen may represent playing cards or other items.

In both the mechanical and video type gaming machines, to spin the reels or otherwise initiate game play, a player inserts a token or selects a credit representing a monetary value and then pulls a handle or pushes a button. The token may be coin, currency or the like; credit may be provided by a credit or debit card mechanism. For convenience, all such tokens and credits are referred to herein as simply "coins." The slot machine then randomly stops the spinning reels at selected reel stop positions so that each reel displays a randomly-selected one of its symbols through the glass panel in visual association with the win line. For each reel, the displayed symbol is the reel outcome.

In earlier mechanical or electromechanical gaming machines, the spinning reels were mechanically stopped to determine the reel outcome and sensors detected the reel stop positions to determine whether the player had achieved a winning game outcome. In these traditional machines, the reel both determined and displayed the game outcome.

In more recent developments, a microprocessor or other control circuit randomly determines each reel outcome, and thus the overall game outcome. The microprocessor causes the reels to stop so as to display the selected reel outcomes. In these newer machines, the reel's function is simply to display the reel outcome determined by the microprocessor. In accordance with one known method, each reel stop position is associated with a symbol. The microprocessor then selects one of the reel stop positions, and a reel control mechanism stops the spinning reel to display the symbol at the selected position.

Regardless of how reel outcomes are selected, the combination of displayed symbols is the game result or outcome. Each game outcome corresponds to a payout, a number of which may be zero. Payouts may be associated with game outcomes either mechanically for older machines or electronically, by, for example, using payout tables in memory.

After game outcome is determined, the gaming machine ascertains the corresponding payout, and actuates a coin hopper or the like to dispense the winning payout.

To increase player excitement and interest, some machines dynamically increment payout amounts corresponding to one or more game outcomes. An example of one such technique is provided in U.S. Pat. No. 5,123,649.

Because of the repetitive nature of many gaming machines, there exists a continuing need to develop ever more interesting and exciting games.

SUMMARY

Therefore, it is an object of the invention to provide a gaming machine, such as a reel-type or video slot machine, having a higher level of player appeal. In accordance with the invention, the payout for one particular game outcome is selected randomly from a predetermined range of payout amounts. Prior to game play, the player is provided with a range of possible payouts for this particular game outcome and the actual payout, called the metered payout, is randomly selected only after this game outcome occurs.

Preferably, the selected metered payout amount is displayed to the player on a payout meter. Prior to and during game operation, the meter displays the lowest value of the range of payout amounts corresponding to this particular game outcome. If this game outcome occurs, the metered payout amount is randomly selected, and the payout meter is incremented at a rate of one number per second until it displays the randomly selected metered payout amount.

In one embodiment of the invention, the gaming machine includes selection logic responsive to a winning game outcome for selecting a metered payout amount from a predetermined range of payout amounts. The gaming machine also includes a meter display visible to the player of the incremental display of numbers from a lower predetermined payout amount to the selected metered amount.

In another embodiment of the invention, when the metered amount is finally displayed on the meter, the gaming apparatus actuates a coin hopper or like device to dispense the winning payout. If a large range is to be incremented through, the gaming apparatus can actuate the coin hopper to begin dispensing the metered payout amount while the meter display is still incrementing.

In a further embodiment of the invention, while the meter display is showing the incremental display of numbers from the lower predetermined payout amount to the selected metered payout amount, the gaming apparatus actuates the coin hopper to begin dispensing the metered payout amount synchronously with the incremental display of numbers.

DETAILED DESCRIPTION OF THE INVENTION

A. Technical Environment

Figure 1:
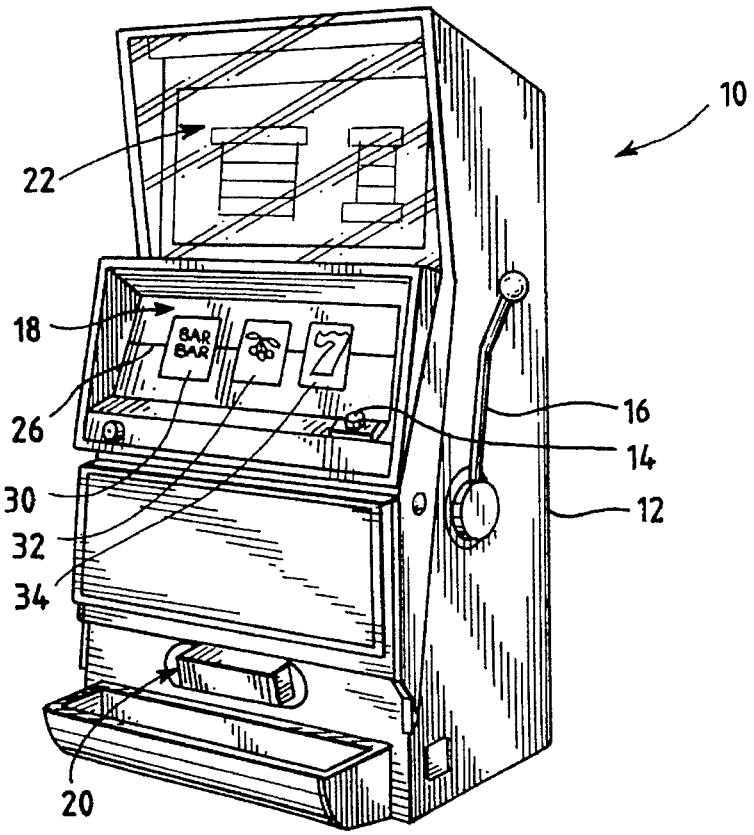
FIG. 1 is a perspective view of an electronically-controlled reel-type gaming machine in accordance with one embodiment of the invention.

FIG. 1 illustrates a reel spinning type gaming machine 10 in accordance with the invention. The gaming machine 10 includes a housing 12, a coin input slot 14 into which a user inserts coins or tokens, and a handle 16, which a user pulls to initiate game play after one or more coins or tokens have been inserted into the slot 14. In lieu of the handle 16, the user can initiate game play by pressing a button, key or other activator device. A coin hopper (not shown) is located inside housing 12 and selectively dispenses coins to a player through a coin output slot 20. A backlighted top glass 22 displays pay schedules, i.e., payout amounts for various winning symbol combinations.

The gaming machine 10 also features a reel display area 18, in which a number (in this case, three) of rotatable reels 30, 32 and 34 are displayed along a win line 26. Each one of the reels 30, 32 and 34 includes a set of symbols, shown in FIG. 1 as "BAR/BAR" cherries and "7" which are repetitively serially displayed in visual association with the win line 26 as the reels spin.

The reels 30, 32 and 34 may be mechanically spinning reels which are mounted for rotation through a number of predetermined angular positions or "reel stop positions" relative to the win line 26. The operation of such a mechanical reel display mechanism is more fully disclosed in U.S. Pat. No. 4,095,795 issued to Saxton. The symbols are displayed on the periphery of the reels to indicate the reel stop positions.

Figure 2:
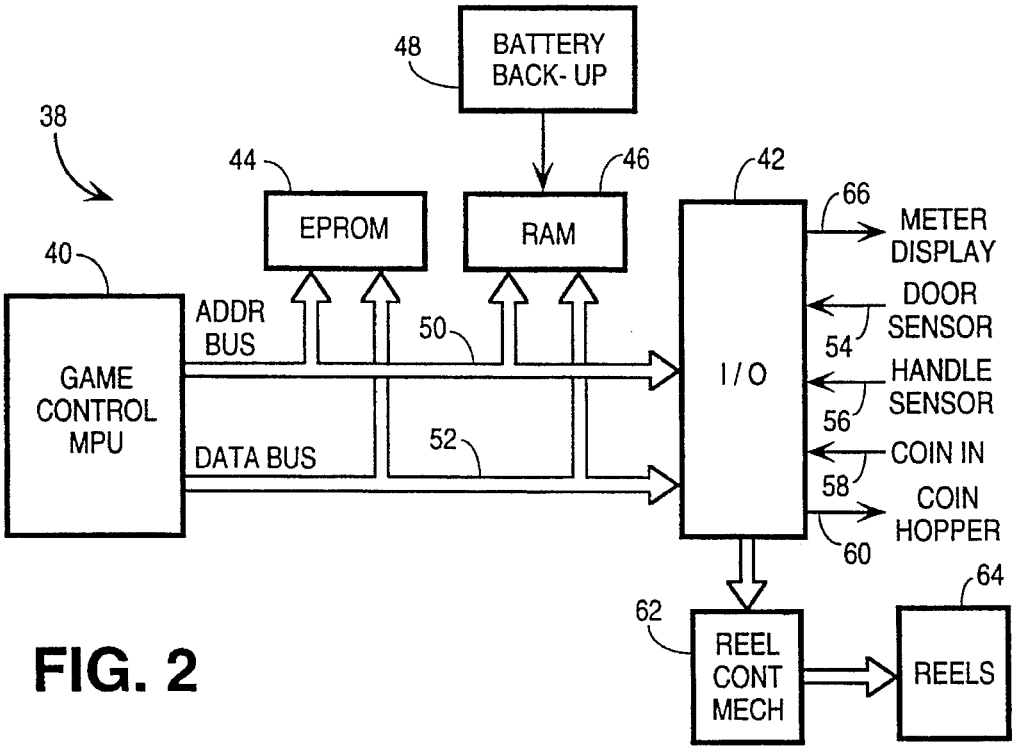
FIG. 2 is a block diagram of the electronic control circuit for the gaming machine of FIG. 1.

Referring to FIG. 2, the gaming machine 10 includes an electronic control circuit 38. The electronic control circuit 38 has a game control microprocessor 40, such as a Motorola 68000, and an input-output interface 42. Game control software and data as described below are stored in an erasable programmable read-only memory ("EPROM") 44. The game control software is executed by the microprocessor 40 for enabling operation of the gaming machine 10 in accordance with the invention. Working storage for game data is provided by a random access memory ("RAM") 46. Preferably, the RAM 46 is associated with battery back-up 48 to prevent data loss in the event of a power failure. An address bus 50 and a data bus 52 interconnect the microprocessor 40, the input-output interface 42, EPROM 44 and RAM 46.

The input-output interface 42 includes inputs for a door sensor signal 54, a handle sensor signal 56, a coin input sensor signal 58, a coin hopper output signal 60, and a meter display output signal 66. The door sensor signal 54 is operatively associated with a door sensor (not shown), and indicates when an access door (not shown) in the housing 12 is open. The handle sensor signal 56 is coupled to a handle sensor (not shown), and indicates when the user has pulled the handle 16. The coin input sensor signal 58 is coupled to a coin input sensor (not shown), and indicates the insertion of coins or tokens by the user into the coin input slot 14. The coin hopper output signal 60 is coupled to a coin hopper (not shown), which is secured inside housing 12. When a player wins, the game control circuit 38 actuates the coin hopper output signal which causes the coin hopper to dispense a predetermined number of coins through the coin output slot The input-output interface 42 is also coupled to a reel control mechanism 62. The reel control mechanism 62 is operatively associated with reels 30, 32, and 34, which are shown in FIG. 2 as block 64. The reel control mechanism 62 includes a stepper motor or the like for rotating the reels 32 and 34 in response to commands from the electronic control circuit 38. As is known, the reel control mechanism 62 has the ability to stop each of the reels 30, 32 and 34 at selected reel stop positions.

Figure 3:
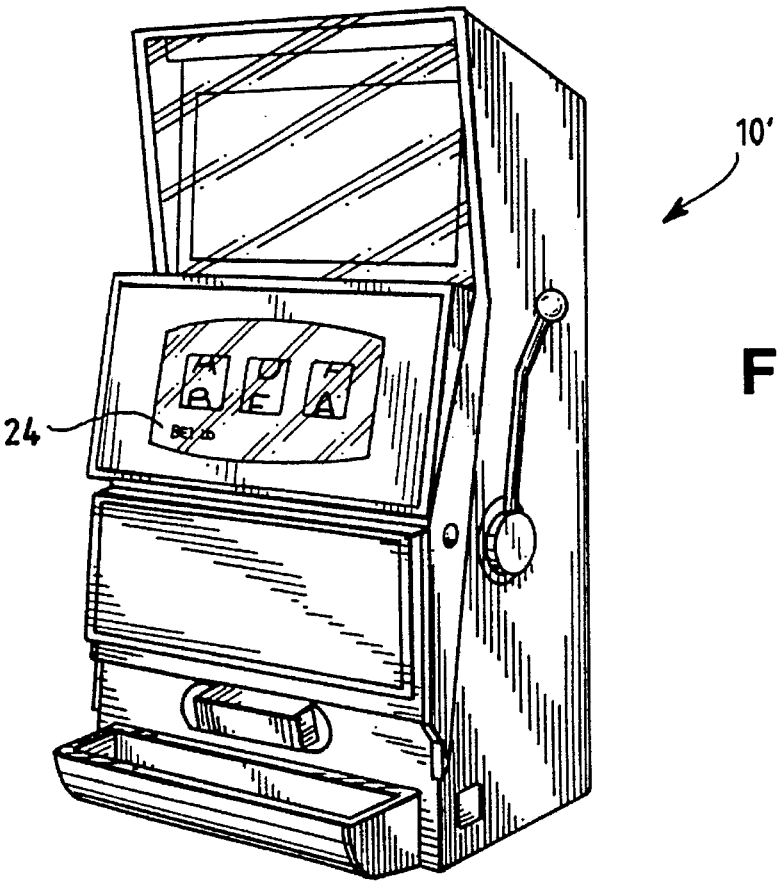
FIG. 3 is a perspective view of an electronically controlled video reel-type gaming machine in accordance with a second embodiment of the invention.
Figure 4:
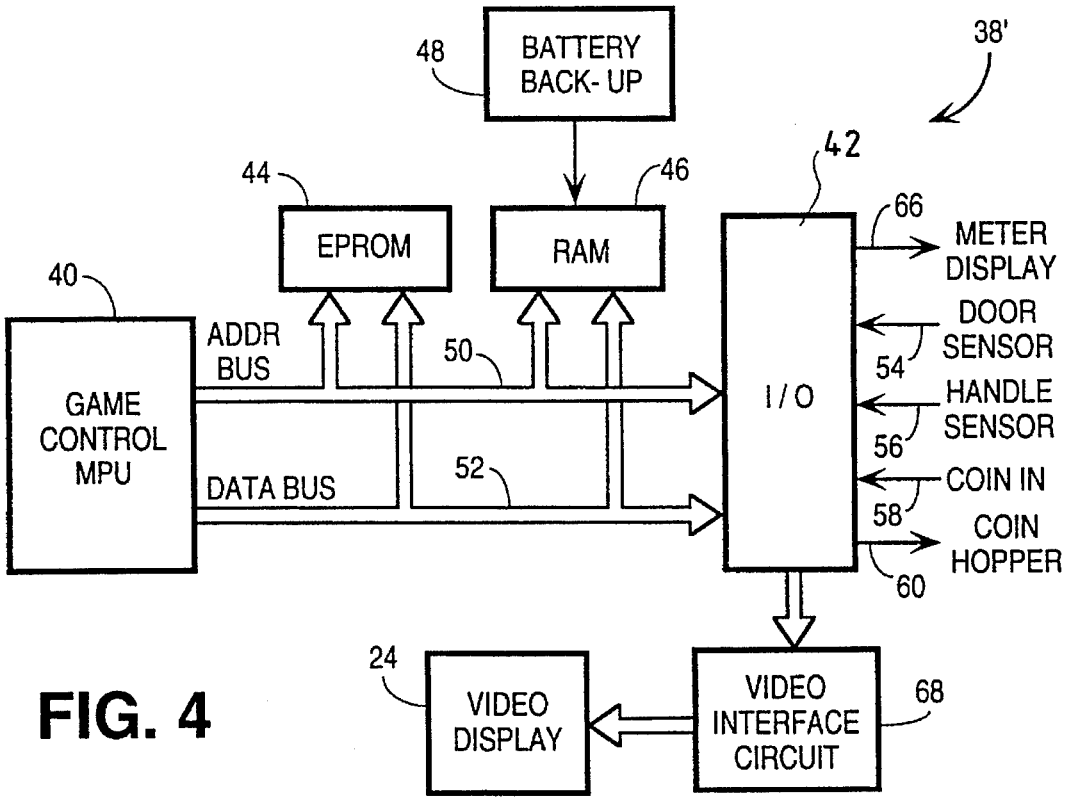
FIG. 4 is a block diagram of the electronic control circuit for the gaming machine of FIG. 3.

Referring to FIGS. 3 and 4, an alternative embodiment of the invention is shown in which the reels 30, 32 and 34 may be computer-generated images of the physically spinning reels described above. Reference numbers in FIGS. 3 and 4 corresponding to elements in FIGS. 1 and 2 are the same. In this embodiment, the reel display area 18 includes a video display 24, or other suitable display device, as illustrated in the gaming machine 10' of FIG. 3.

FIG. 4 illustrates an alternative embodiment 38' of the electronic control circuit 38. The alternative control circuit 38' is adapted for use with the video gaming machine shown in FIG. 3. To this end, control circuit 38' includes video interface circuit 68 which is coupled to input-output interface 42. The video interface circuit is coupled to the video display 24, and enables control circuit 38' to display images of reels 30, 32 and 34 on video display 24, and to cause those images to simulate the starting and stopping operations described above in connection with the reel control mechanism To operate the gaming apparatus 10, a user inserts coins or tokens into the coin input 14 and pulls the handle The control circuit 38 detects the insertion of coins via coin input sensor signal 58, and the pulling of the handle 16 via the handle sensor signal 56.

At approximately the same time, the microprocessor 40, via input-output interface 42 and reel control mechanism 62 (or in the case of video slot machine 10' video interface circuit 68) initiates the rotation of reels 30, 32 and 34. The microprocessor 40 then stops the reels 30, 32 and 34 to display the randomly selected game outcome.

B. Selection of Metered Payout Amount.

For each reel 30, 32 and 34, each combination of the displayed symbols on the win line 26 can be considered as a game outcome. For video gaming machines, the displayed symbols may represent, for example, playing cards comprising a poker hand in which "winning poker hands" such as a high pair, two pair or three of a kind or similar hands are winning game outcomes.

Figures 5, 6:
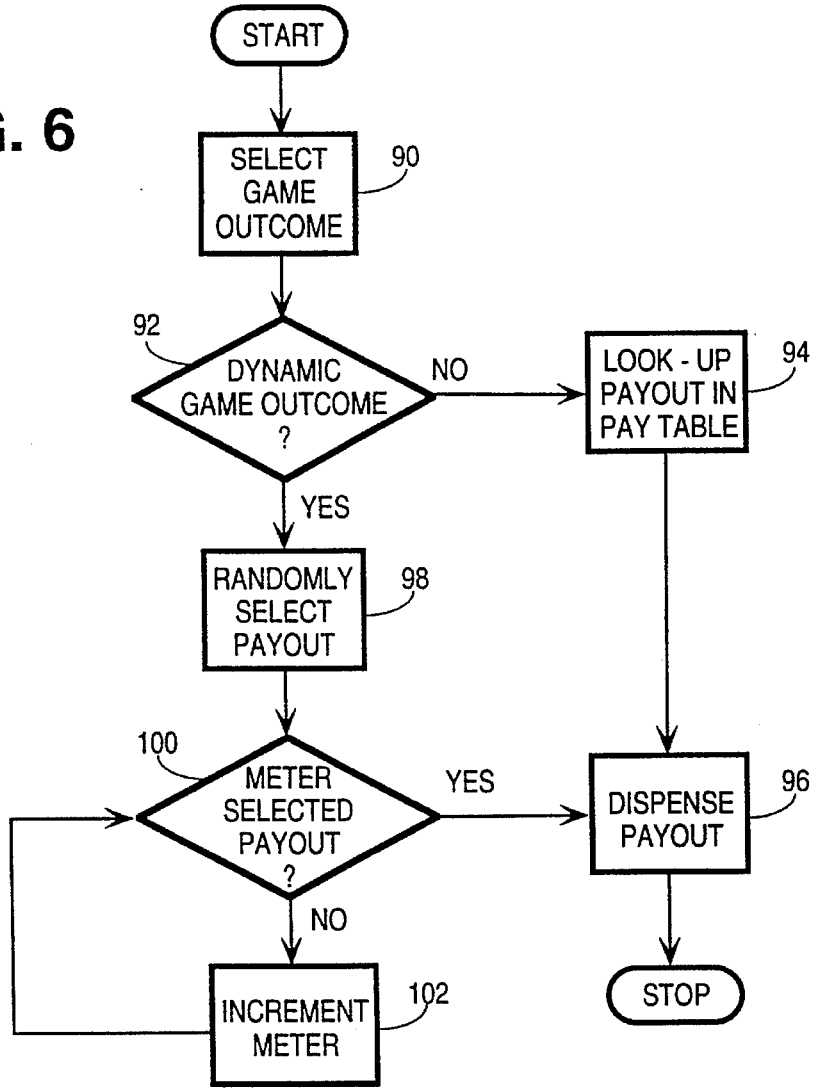
FIG. 5 is a diagrammatic illustration of a portion of the memory of the electronic control circuits of FIGS. 2 and 4.
FIG. 6 is a flow chart of the payout amount selection logic of the electronic control circuit shown in FIGS. 2 and 4.

In accordance with the present invention, the electronic control circuit 38 randomly selects a game outcome. Referring to FIGS. 2, 5 and 6, if the game outcome is a winning game outcome, it will be seen that microprocessor 40, in some cases, selects a game outcome in cooperation with the software and data stored in the EPROM 44 and the RAM 46.

In the gaming machine 10, the microprocessor 40 randomly selects stop positions for each of the reels 30, 32 and 34. Once the reel stop positions have been selected, the microprocessor 40 determines whether a winning game outcome is present and how much the payout should be. The microprocessor 40 accesses the payout amount table stored in the memory of EPROM 44. In the preferred embodiment, the microprocessor 40 can also access a metered payout amounts table 80 stored in the EPROM 44 memory.

Referring to FIG. 5, each of the possible metered payout amounts is stored in a table 80, which represents a block of memory in the EPROM 44. Each line (or "record") of the table 80 contains two columns (or "fields"): a probability factor field 82 and metered payout amount field 84.

The probability factor field 82 allows a probability factor or weighting to be associated with each of the payout amounts. In the illustrated embodiment, the probability factor field 82 contains successive subranges of the range 0 through N, where N is equal to 999. Other values of N may be used. The larger the value of N, the broader the spectrum of probabilities which may be assigned to the payout amounts. The payout amount field 84 contains payout amounts, of which each payout amount corresponds to a subrange of the probability factors.

FIG. 6 is a logical flow chart illustrating operation of the microprocessor 40 in randomly selecting a metered payout amount from the table 80. In summary, the microprocessor 40 generates a random number between 0 and N, and then steps through the table 80 until it locates the line having the subrange which contains the random number. The payout amount stored in that particular line of the table 80 is the metered payout amount. For clarity, the term "metered payout amount" shall mean the randomly selected payout amount corresponding to a particular winning game outcome.

It will be noted that game combinations corresponding to very high payouts can be given a small subrange (as small as 1, for example). Where N is set to a large number, the use of small subranges means the odds of drawing such high payout game combinations can be very low. These low odds make it economically feasible for game owners to offer larger potential payouts for certain game outcomes which in turn tend to increase player interest in the game.

This process is described more fully as follows. Beginning at step 90, the microprocessor 40 determines if a winning game outcome has occurred. At step 92, if a winning game outcome has occurred, the microprocessor 40 determines if a metered payout is to selected. If the payout is not to be metered, at step 94, the microprocessor 40 will look up the payout amount in a pay schedule table resident in EPROM 44. At step 96, the payout amount is dispensed.

If a metered payout amount is to be selected, beginning at step 98, the microprocessor 40 generates a random number X between 0 and N; in this case, N equals 999. A memory variable or "pointer" tracks the current record of the table At the step 98, the pointer is set to the first line of the table 80, making line 1 the "current" record. The microprocessor 40 examines the current record, and compares the randomly generated number X to the subrange set forth in the probability field 82. If X falls within the subrange, then control moves to step 100.

If X does not fall within the subrange set forth in the probability field 82, control remains at step 98, where the pointer is incremented by one to advance the microprocessor 40 to the next record. Step 98 is repeated until a metered payout amount is selected from the table 80. Control then moves to step 100.

Figure 7:
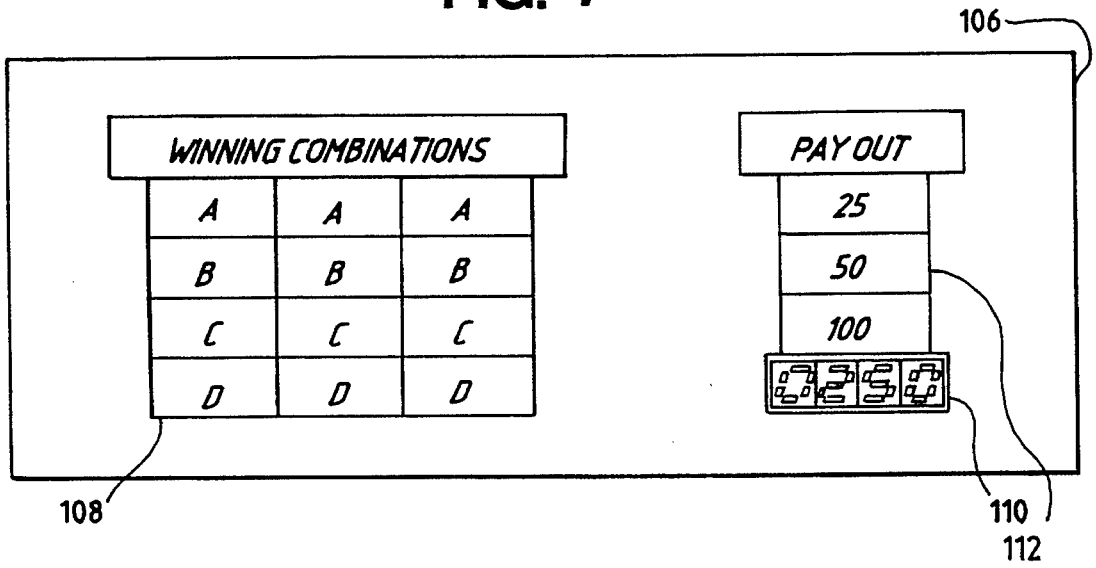
FIG. 7 is an illustration of the top glass display of the reel-type gaming machine of FIG. 1 according to one embodiment of the invention.

At step 100, if the metered payout amount is the same as the payout amount shown on the meter display 110 in FIG. 7, the metered payout amount is dispensed at step 96. If the metered payout amount is not the same as the payout amount shown on the meter display 110, control moves to step 102, where the meter display 110 is incremented to the metered payout amount. Control returns to step 100. Control then advances to step where the metered payout amount is dispensed.

FIG. 7 provides an illustration of a top glass 106 which is a simplified version of the top glass 22 of FIG. 1, including the meter display 110. For clarity, a simple pay schedule 108 and the meter display 110 are depicted in FIG. 7. In practice, on most gaming machines 10 all pay schedules are displayed on the top glass 22. On the glass 106, the pay schedule 108 displays winning game outcomes of the reels 30, 32 and 34. A column 112 displays payout amounts for the first three winning game outcomes in the pay schedule 108. The display meter 110 displays the lowest possible payout amount for the fourth winning game outcome until that winning game outcome has occurred and the microprocessor 40 has selected a metered payout amount that differs from the amount displayed on the meter display 110. The meter display 110 then incrementally displays the series of numbers from the lower amount to the metered payout amount.

Figure 8:
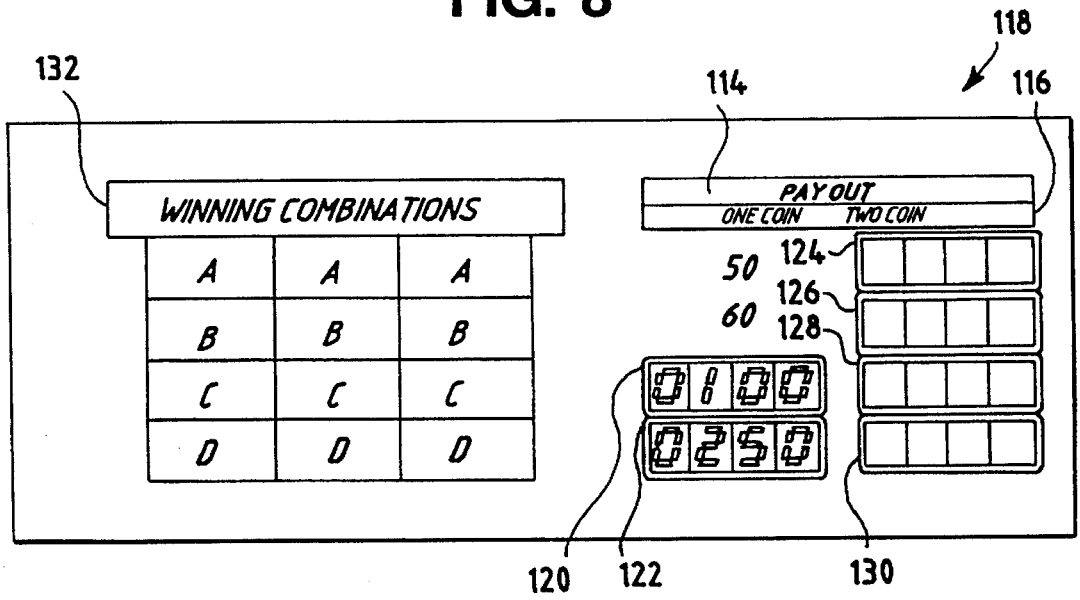
FIG. 8 is an illustration of the top glass display of the reel-type gaming machine of FIG. 1 according to a second embodiment of the invention.

FIG. 8 provides an illustration of a top glass 118 which is a simplified version of the top glass 22 of FIG. 1, including a set of meter displays 120, 122, 124, 126, 128, and 130. For clarity, only two pay schedules and meter displays 120 through 130 are depicted in FIG. 8 instead of all the pay schedules which on most gaming machines 10 are typically displayed on the top glass 22. In the alternative, the pay schedules may be displayed on a video screen or other display device. On the glass 118, a column 132 displays winning game outcomes of the reels 30, 32 and 34. A pair of columns, 114 and 116, display payout amounts for one and two coins inserted respectively. A column 114 displays payout amounts for the first two winning game outcomes. The display meters 120 and 122 display the lowest possible payout amount for the third and fourth winning game outcomes. When a winning game outcome has occurred and the microprocessor 40 has selected a metered payout amount that differs from the amount displayed on the corresponding meter display 120 or 122, that meter display 120 or 122 then incrementally displays the series of numbers from the lower amount to the metered payout amount.

Likewise, the meter displays 124, 126, 128 and 130 in column 116 display the lowest possible payout amount for the respective winning game outcomes. When a winning game outcome for the corresponding meter display 124, 126, 128 or 130 has occurred and the microprocessor 40 has selected a metered payout amount that differs from the amount displayed on the corresponding meter display 124, 126, 128 or 130, that meter display 124, 126, 128 or 130 then incrementally displays the series of numbers from the lower amount to the metered payout amount.

The foregoing operation is generally the same in both the physical reel and video reel embodiments of the gaming machine 10. There are numerous alternative ways in which the table of metered payout amounts can be set up as well as numerous alternative ways in which the meter can display the metered payout amounts in accordance with the invention.

By creating suspense surrounding the metered payout and the incrementing display as described above, player excitement and interest can be increased significantly.

I claim:

1. A gaming machine, comprising:

initiating means responsive to player input for generating an initiate signal;

control means responsive to said initiate signal for randomly selecting a game outcome from a plurality of possible game outcomes that includes a metered winning game outcome;

pay means responsive to said control means for selecting a metered payout amount when the selected game outcome is said metered winning game outcome, said metered payout amount being randomly selected from a predetermined range of payout amounts;

game display means responsive to said control means for displaying said game outcome;

meter display means responsive to said pay means for displaying said metered payout amount;

payout means operatively associated with said pay means for generating a payout signal in response to said selection of said metered payout amount; and dispensing means responsive to said payout signal for dispensing said metered payout amount.

2. A gaming machine according to claim 1 further including meter display control means operatively associated with said pay means for providing an incremental display of numbers from a lower predetermined amount to said metered payout amount on said meter display.

3. A gaming machine according to claim 2 wherein said payout means includes means operatively associated with said meter display control means for controlling the dispensing means to incrementally dispense said metered payout amount synchronously with said incremental display of numbers.

4. A gaming machine according to claim 2 wherein said payout means includes means operatively associated with said meter display control means for generating said payout signal upon completion of said incremental display of numbers.

5. A gaming machine, comprising:

means for generating an initiate signal in response to a user input;

control means responsive to said initiate signal for randomly selecting a game outcome from a plurality of possible game outcomes that includes a metered winning game outcome;

logic means responsive to said initiate signal for randomly selecting a metered amount from a predetermined range of payout amounts;

game display means responsive to said control means for displaying said game outcome;

a meter display responsive to said logic means for displaying said metered payout amount;

meter display control means operatively connected to said meter display for incrementally displaying a series of numbers on said meter display from a lower amount to said metered payout amount;

payout means for generating a payout signal in response to said selection of said metered payout amount; and dispensing means responsive to said payout signal for dispensing said metered payout amount.

6. A method for providing a dynamic payout amount in a gaming apparatus, comprising the steps of:

storing a table of payout amounts for a plurality of winning game outcomes including a metered game outcome wherein said payout amount for said metered game outcome is a range of payout amounts having a predetermined range, each of said winning game outcomes corresponding to a predetermined combination of said symbols;

randomly selecting from said range a metered payout amount when a metered game outcome occurs;

displaying incrementally said range from the lowest value of said range to said metered payout amount; and dispensing said metered payout amount.

7. The method according to claim 6 further including displaying said metered payout amount.

* * * * *

UNITED STATES PATENT AND TRADEMARK OFFICE

CERTIFICATE OF CORRECTION

PATENT NO. : 5,494,287

DATED : February 27, 1996

INVENTOR(S) : Robert P. Manz

It is certified that error appears in the above-identified patent and that said Letters Patent is hereby corrected as shown below:

Col. 3, line 67, after "slot" insert -- 20. --.

Col. 4, line 5, after "reels" insert -- 30, --.

Col. 4, line 20, after "machine" insert -- 10' --.

Col. 4, lines 27 and 28, after "mechanism" insert -- 62. --

Col. 4, line 30, after "handle" insert -- 16. -- .

Col. 5, line 61, after "step" insert -- 96, -- .

Signed and Sealed this

Thirtieth Day of April, 1996

Bruce Lehman

*Attest:*

BRUCE LEHMAN

*Attesting Officer*

*Commissioner of Patents and Trademarks*